US011708721B2

(12) United States Patent
Huf et al.

(10) Patent No.: US 11,708,721 B2
(45) Date of Patent: Jul. 25, 2023

(54) SYSTEM FOR GUIDING A FLEXIBLE CURTAIN

(71) Applicant: REMIS Gesellschaft für Entwicklung und Vertrieb von technischen Elementen mbH Köln, Cologne (DE)

(72) Inventors: Daniel Huf, Cologne (DE); Semsi Hajredinaj, Dusseldorf (DE)

(73) Assignee: REMIS Gesellschaft für Entwicklung und Vertrieb von technischen Elementen mbH Köln, Cologne (DE)

( * ) Notice: Subject to any disclaimer, the term of this patent is extended or adjusted under 35 U.S.C. 154(b) by 160 days.

(21) Appl. No.: 17/143,860

(22) Filed: Jan. 7, 2021

(65) Prior Publication Data

US 2021/0214997 A1 Jul. 15, 2021

(30) Foreign Application Priority Data

Jan. 10, 2020 (EP) ..... 20151120

(51) Int. Cl.
*E06B 9/54* (2006.01)
*E06B 9/58* (2006.01)

(52) U.S. Cl.
CPC ..... *E06B 9/54* (2013.01); *E06B 9/58* (2013.01); *E06B 2009/543* (2013.01)

(58) Field of Classification Search
CPC ... E06B 9/54; E06B 9/58; E06B 9/581; E06B 9/582; E06B 2009/543; E06B 2009/588
See application file for complete search history.

(56) References Cited

U.S. PATENT DOCUMENTS 4,776,379 A * 10/1988 Kraeutler ..... E06B 9/0692 160/84.06
6,408,922 B2 * 6/2002 Desrochers ..... E06B 9/54 160/31
6,463,983 B1 * 10/2002 Lang ..... E06B 9/54 160/273.1
7,210,513 B2 * 5/2007 Goldenberg ..... E06B 9/54 160/381
7,861,761 B2 * 1/2011 Martineau ..... E06B 9/54 160/31
7,931,070 B2 * 4/2011 Chino ..... E06B 9/52 160/84.06
7,967,052 B2 * 6/2011 Lin ..... B60J 7/0015 160/370.22
7,967,345 B2 * 6/2011 Davies ..... E06B 9/54 292/37
8,528,623 B2 * 9/2013 Roberts ..... E06B 9/54 160/267.1
9,249,621 B2 * 2/2016 Dwarka ..... E06B 9/44
(Continued)

FOREIGN PATENT DOCUMENTS

EP 0790384 A1 8/1997
EP 2675965 B1 8/2015

OTHER PUBLICATIONS

Extended European Search Report regarding corresponding European Patent Application No. 21213089.2, dated Apr. 13, 2022.
(Continued)

*Primary Examiner* — Johnnie A. Shablack
(74) *Attorney, Agent, or Firm* — Lewis & Reese, PLLC

(57) ABSTRACT

The present invention relates to a system for guiding a flexible curtain for at least partially closing an opening.

24 Claims, 5 Drawing Sheets

(56) References Cited

U.S. PATENT DOCUMENTS

| | | | | |
|---|---|---|---|---|
| 9,351,599 | B2 * | 5/2016 | Roberts | E06B 9/54 |
| 9,624,722 | B2 * | 4/2017 | Hummel | E06B 9/58 |
| 10,087,681 | B2 * | 10/2018 | Lin | E06B 3/4609 |
| 10,662,705 | B2 * | 5/2020 | Hall | E04B 2/7453 |
| 10,760,329 | B1 * | 9/2020 | Maas | E06B 3/9642 |
| 11,014,434 | B2 * | 5/2021 | Kobayashi | B60J 7/0015 |
| 11,053,733 | B2 * | 7/2021 | Montanaro | E06B 9/58 |
| 11,105,148 | B2 * | 8/2021 | Shipman | E06B 9/78 |
| 2001/0042346 | A1 * | 11/2001 | Brioschi | E06B 9/54 49/447 |
| 2003/0079844 | A1 | 5/2003 | DeBlolck et al. | |
| 2005/0098276 | A1 * | 5/2005 | Agliolo Quartalaro | E06B 9/54 160/276 |
| 2006/0054287 | A1 * | 3/2006 | Dickinson, III | E06B 9/54 160/271 |
| 2007/0199667 | A1 * | 8/2007 | Jumbeck | E06B 9/54 160/274 |
| 2009/0236050 | A1 * | 9/2009 | Marzilli | E06B 9/40 160/241 |
| 2018/0148975 | A1 * | 5/2018 | Roberts | E06B 9/58 |
| 2019/0234142 | A1 * | 8/2019 | Grützner | H02G 11/006 |
| 2019/0292846 | A1 * | 9/2019 | Conrad | E06B 9/50 |
| 2020/0149346 | A1 * | 5/2020 | Solomaniuck | E06B 9/58 |
| 2021/0246721 | A1 * | 8/2021 | Fan | E06B 9/44 |

OTHER PUBLICATIONS

Partial Extended Search Report regarding corresponding European Patent Application No. 20151120.1, dated Jul. 6, 2020.

Extended Search Report regarding corresponding European Patent Application No. 20151120.1, dated Sep. 4, 2020.

* cited by examiner

SYSTEM FOR GUIDING A FLEXIBLE CURTAIN

CROSS REFERENCE TO RELATED APPLICATIONS

This application claims priority to European Application Serial No. 20151120.1, filed Jan. 10, 2020, which is incorporated herein by reference in its entirety.

FIELD OF THE INVENTION

The present invention relates to a system for guiding a flexible curtain for at least partially closing an opening.

STATE OF THE ART

Systems for closing an opening with a flexible curtain usually comprise frame elements along which a support strip or handle strip connected to the curtain is guided, whereby the opening can be closed. A common application is, for example, closing a door or a window with an insect screen or a plissé.

The movement of the support strip along the frame elements may be impaired by dirt on the sliding surfaces of the support strip or of the frame element and damage may occur to the sliding surfaces, which in the worst case may lead to the movement being permanently disturbed. A further problem with previous systems consists in that the curtain may be damaged or may even tear in its stretched state if an external force is applied to it, for example, if a door with an insect screen is slammed by a gust of wind and the door handle collides with the insect screen.

EP 2 675 965 B1 relates to a conventional insect protection device comprising a frame and a pulling strip, wherein a hanging fabric or curtain is movable by means of the pulling strip such that an opening delimited by the frame can be closed with the hanging fabric. The frame comprises a lower frame profile, on which the pulling strip is slidably arranged with a slider. The slider is positively guided on the lower frame profile.

However, this type of guiding a curtain leads to the problem that the curtain may be damaged in its spread-out state, i.e., when the opening is at least partially closed, e.g., when a foreign object collides with the curtain. As a consequence, the function of the curtain may be impaired. Furthermore, this guide involves the risk that easily accessible areas of the guide become soiled, which may lead to increased friction and therefore faster wear or, in an extreme case, to a blockage of the guide.

Therefore, the present invention is based on the object of guiding a flexible curtain along an opening in order to at least partially close the opening. In particular, the aforementioned soiling of the guide should be avoided as far as possible so that as little friction as possible arises between the parts of the guide system moving relative to each other and no blockage of the guide can occur. A further object of the present invention consists in preventing damage when a foreign body hits a support strip or a curtain that is attached thereto and at least partially closes an opening.

SUMMARY

The mentioned objects are achieved by the system according to the independent claims. Preferred embodiments are indicated in the dependent claims.

The present invention relates to a system for guiding a flexible curtain for at least partially closing an opening, for example, a door or a window, preferably a door or a window of a vehicle and particularly preferably a door or a window of a recreational vehicle.

The system comprises an upper, a lower and at least one lateral frame element, which delimit an opening, i.e., define an area to be closed. A first edge of a flexible curtain is fixed to the lateral frame element. The system according to the invention further comprises a support strip, which is configured to hold a second, opposite edge of the flexible curtain. An upper and a lower end of the support strip are displaceably guided in the upper and the lower frame element, respectively. The lower frame element comprises a guide area and a cover area covering the guide area, which extend along a longitudinal direction of the lower frame element. Thus, it is possible to prevent dirt from getting into the guide area. Furthermore, the cover area may also serve as a stable tread strip, for example in the case of a door curtain. Furthermore, by designing the cover area accordingly, it is possible to positively influence the aesthetics of the lower frame element, for example, in that the guide area and the elements necessary for guiding are hidden. The lower end of the support strip comprises a sliding element, which is or is being displaceably engaged with the guide area. Additionally, the sliding element may be supported relative to the lower frame element by means of sliders.

There is preferably a first distance between the lower end of the support strip and the cover area. The first distance is preferably at least 1 mm and particularly preferably at least 2 mm. Furthermore, the first distance may be at least 3 mm and, for example, between 3 mm and 5 mm.

The frame elements as well as the support strip are preferably made of metal or plastic, preferably of aluminum. Alternatively, the frame elements and/or the support strip are preferably made of polyvinyl chloride (PVC), polyamide (PA), polyurethane (PU) or a compound of acrylonitrile butadiene styrene (ABS) and polyvinyl chloride (PVC). One or more frame elements may also be an integral part of a window or door. For example, the system according to the invention may be used, for example, in mobile homes. In this case, the system according to the invention may be fitted into a door or window of a mobile home. Alternatively, one or more frame elements of the system may be an integral part of a window or door of the mobile home and, for example, be identical to one or more frame elements of the window or door.

The flexible curtain may comprise one or a combination of the following elements: insect screen or mesh, plissé, woven fabric, cloth, pleated insect gauze, honeycomb plissé and honeycomb insect gauze.

Additionally, the system according to the invention may comprise a second lateral frame element that delimits the opening on a second side. The second lateral frame element is preferably configured to be engaged with the support strip when the flexible curtain is in a fully stretched state. It is ensured thereby that the flexible curtain completely closes the opening, i.e., without any spaces between the flexible curtain and the frame elements. Particularly preferably, the second frame element is configured to detachably fix the support strip to the second edge of the opening so that a minimum force is required to release the engagement of the support strip and the second frame element. Thus, it is possible to prevent the support strip from unintentionally disengaging from the second edge of the opening causing the opening to be no longer completely closed. In order to fix the support strip to the second frame element, for example, magnetic elements or a locking mechanism, for example, tensioning hooks, snap hooks, annular snap fits, spring connections or combinations thereof may be used.

The cross-section of the lower frame element and/or the cross-section of the lower end of the support strip are preferably configured as a C-profile. The cover area of the lower frame element preferably extends into the opening formed by the C-profile of the lower end of the support strip so that, viewed from above, the cover area covers the guide area. Alternatively, the cross-section of the lower frame element and/or the cross-section of the lower end of the support strip may have any profile that allows the two elements to engage with each other, e.g., an L-profile or a U-profile, with which a cranked hook engages. The lower frame element and the lower end of the support strip may have different cross-sections.

The lower end of the support strip is preferably an injection molded part made of, for example, polyamide (PA). Alternatively, the lower end of the support strip may comprise or consist of metal, preferably aluminum or brass. Furthermore, the lower end of the support strip may comprise a bushing that is made of a metal and preferably embedded in a plastic, particularly preferably in a thermoplastic. For example, polyoxymethylene (POM), polyamide (PA) or polytetrafluoroethylene (PTFE) are suitable therefor.

The sliding element and/or the guide area of the lower frame element preferably comprise connecting elements in order to be brought into engagement with each other. These connecting elements may preferably be configured as a bar or projection and/or recess and/or as a joint and/or as elastic elements and/or as magnetic elements which are configured to be brought into engagement with a corresponding connecting element of the guide area of the lower frame element and/or the sliding element. Alternatively, both the guide area of the lower frame element and the sliding element may comprise one or more connecting elements and one or more recesses. The connecting element may be configured as a projection or bar which engages with a groove of the respective other connecting partner. Preferably, the at least one connecting element extends vertically. Alternatively, the connecting element may be configured horizontally or obliquely, i.e. a combination of vertically and horizontally, in order to enable the sliding element to be guided along the lower frame element in accordance with requirements.

Preferably, the recess and/or the connecting element is provided on a lower side of the sliding element facing the upper side of the guide area. The advantage of such an arrangement consists in that the engagement of the sliding element on the lower frame element cannot be unintentionally released due to gravity.

The sliding element preferably comprises a brush on a side facing the guide area to remove unwanted particles from the guide area when the sliding element is moved relative to the lower frame element. Thus, low-friction sliding of the sliding element can be ensured along the lower frame element.

The lower frame element preferably comprises a cord area, through which a cord is passed to tension the flexible curtain. Such a tensioning mechanism is common for such guide systems of flexible curtains and is described, for example, in EP 2 675 965 B1. The cord is preferably led from the cord area of the lower frame element through the sliding element into the support strip. At least one cord tensioner may be provided in at least one frame element to tension the cord.

The cord area is preferably arranged in the cover area, preferably above the guide area. The cord area may be located at an inner side of the lower frame element or at an outer side at which the lower end of the support strip is located. The lower end of the support strip is preferably configured to guide the cord from the cord area into the support strip.

The lower frame element may comprise a plurality of cord areas in order to achieve complex cord systems/courses.

Preferably the sliding element is releasably engaged with the guide area. In other words, the sliding element can be non-destructively detached from the guide area under the influence of an external force that is not parallel to the area to be closed. The force required to release the engagement and effective at the point of engagement is preferably between 10 and 50 N, preferably between 20 and 40 N, and particularly preferably between 25 and 30 N. The force is transmitted to the engagement by an external force, whereby the engagement is non-destructively released. This external force may be, for example, an external force which acts on the support strip and/or the curtain and the magnitude of which that is required to release the engagement depends on the position at which it acts on the support strip or the curtain. Alternatively, a predetermined breaking point is provided on the sliding element and/or the guide area of the lower end of the support strip, said predetermined breaking point being destroyed under the influence of the external force to release the engagement between the sliding element and the guide area.

Preferably, the sliding element can be brought back into engagement with the guide area by returning it to its original state.

According to a further aspect, the present invention relates to a system for guiding a flexible curtain for at least partially closing an opening. The system comprises an upper, a lower and a lateral frame element, which delimit an opening defining the area to be closed. The lateral frame element is configured to fix a first edge of a flexible curtain to one side of an opening. Furthermore, the system according to the invention includes a support strip configured to hold a second edge of a flexible curtain. An upper and a lower end of the support strip are displaceably guided in the upper and lower frame elements. The lower frame element comprises a guide area. The lower end of the support strip comprises a sliding element. The guide area and the sliding element displaceably engage with each other via connecting elements. At least one of the connecting elements is configured in a deformable manner so that a movement of the support strip perpendicular to the area defined by the opening is made possible. Preferably at least one of the connecting elements is non-destructively and reversibly deformable.

Preferably, at least one of the connecting elements is configured in a multi-part manner, particularly preferably in a two-part manner. The multi-part connecting element preferably comprises at least one joint and/or one bar or projection and/or one elastic element. The joint is preferably a joint or a hinge connection made of metal, e.g. spring steel, or of plastic, e.g., polyurethane. Alternatively, the joint or the hinge connection may consist of a plurality of materials and comprise a rotatably mounted bar or projection.

Further preferably, the lower end of the support strip is structured in a multi-part manner so that the sliding element can be non-destructively uncoupled from the remaining part of the lower end of the support strip. The sliding element may be connected to the remaining part of the lower end of the support strip, for example, by means of magnetic elements.

The sliding element is preferably non-destructively detached from the guide area by a force acting perpendicularly to the area defined by the opening. Preferably, at least one of the connecting elements is deformed for this purpose. Particularly preferably, the bar or projection of the at least one connecting element is tiltable relative to the guide area and/or the sliding element in order to enable the movement of the support strip perpendicular to the area defined by the opening.

The bar or projection is preferably supported by an elastic element in order to return it to its original position once the force acting on it falls below a certain threshold value.

Preferably, the sliding element can be brought back into engagement with the guide area by returning it to its original state.

The system may also comprise a second lateral frame element that delimits the opening on a second side. Preferably, the second frame element is configured to be engaged with the support strip when the flexible curtain is in a fully stretched state.

The system may further comprise a flexible curtain, at least one end of which is attached to the support strip.

According to a further aspect, the present invention relates to a door or window, preferably a door or window for a recreational vehicle, such as, for example, a mobile home or a travel trailer, which comprises a frame comprising one of the above described systems according to the invention.

BRIEF DESCRIPTION OF THE FIGURES

The invention is explained in more detail by means of the annexed Figures.

DETAILED DESCRIPTION

Figure 1:
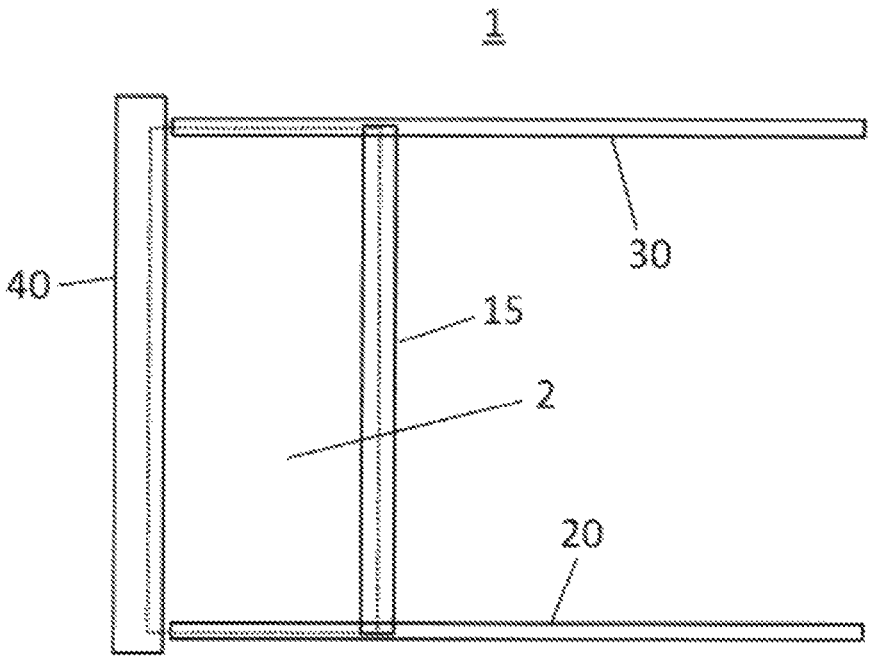
FIG. 1 shows a schematic view of the system according to the invention.

FIG. 1 shows a schematic view of the system 1 according to the invention for guiding a flexible curtain 2 for at least partially closing an opening. The system according to the invention comprises a lower frame element 20, an upper frame element 30 and at least one first lateral frame element 40, which fixes a first edge of the flexible curtain 2 to one (here: the left) side of the opening. A second edge of the flexible curtain 2 is held by the support strip 15, the upper and lower ends of which are guided in the upper and lower frame elements 30, 20. Alternatively, the system according to the invention may comprise a second lateral frame element (not shown), which together with the other frame elements forms a closed frame.

Figure 2:
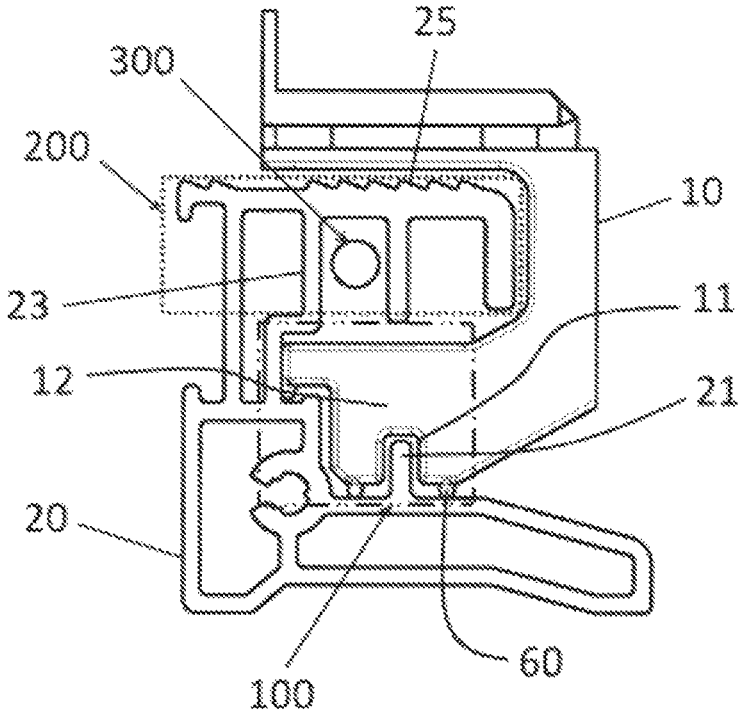
FIG. 2 shows a schematic view of the lower frame element and the lower end of the support strip according to a preferred embodiment of the system according to the invention.

FIG. 2 shows a schematic view of the lower frame element 20 and the lower end 10 of the support strip 15 according to a preferred embodiment of the system according to the invention. The lower end 10 of the support strip 15 engages with a guide area 100 of the lower frame element 20 via a sliding element 12. The sliding element 12 engages with the lower frame element 20 via connecting elements, which are exemplarily shown in FIG. 2 as a projection 21 and a recess 11. The sliding element 12 is further supported relative to the lower frame element by means of sliders 60.

The lower frame element 20 comprises a cover area 200, which extends along a longitudinal direction of the lower frame element and covers the guide area 100. Preferably, when viewed vertically from above, the guide area is completely covered by the cover area 200. Thus, it can be prevented that unwanted particles get into the guide area 100 and impair the movement of the sliding element 12 along the lower frame element 20. The cover area 200 may comprise one or more reinforcing struts 23 to stabilize the cover area 200. This is in particular advantageous if the cover area 200 also serves as a tread strip when the system is used in a door. For this purpose, the top side of the cover area 200 may also comprise ribbing 25, as schematically shown in FIG. 2, to prevent slipping off the tread strip.

Figure 3:
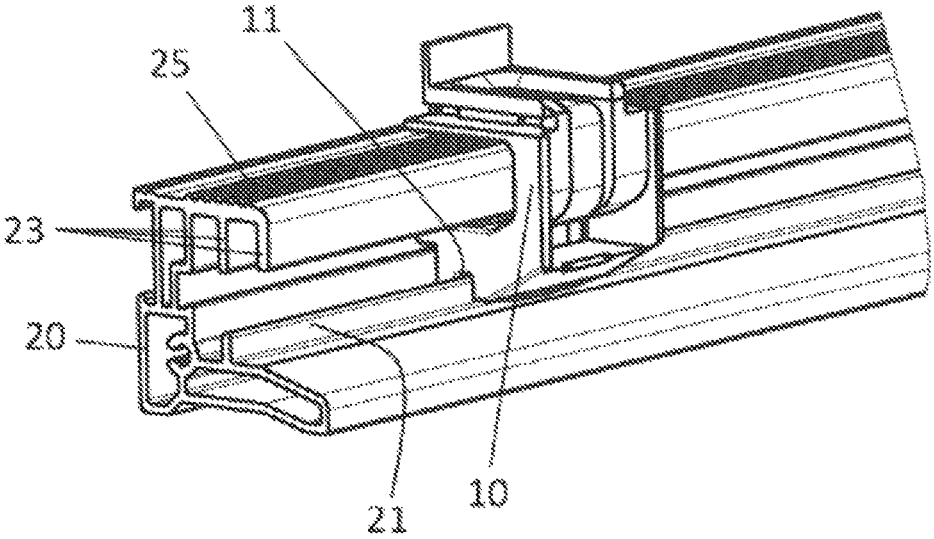
FIG. 3 shows a schematic perspective view of the lower frame element and the lower end of the support strip depicted in FIG. 2 according to a preferred embodiment of the system according to the invention.

FIG. 3 perspectively illustrates how the lower end 10 of the support strip 15 is engaged with the lower frame element 20. The lower end 10 of the support strip 15 may be moved along the longitudinal direction of the lower frame element 20.

Figure 4:
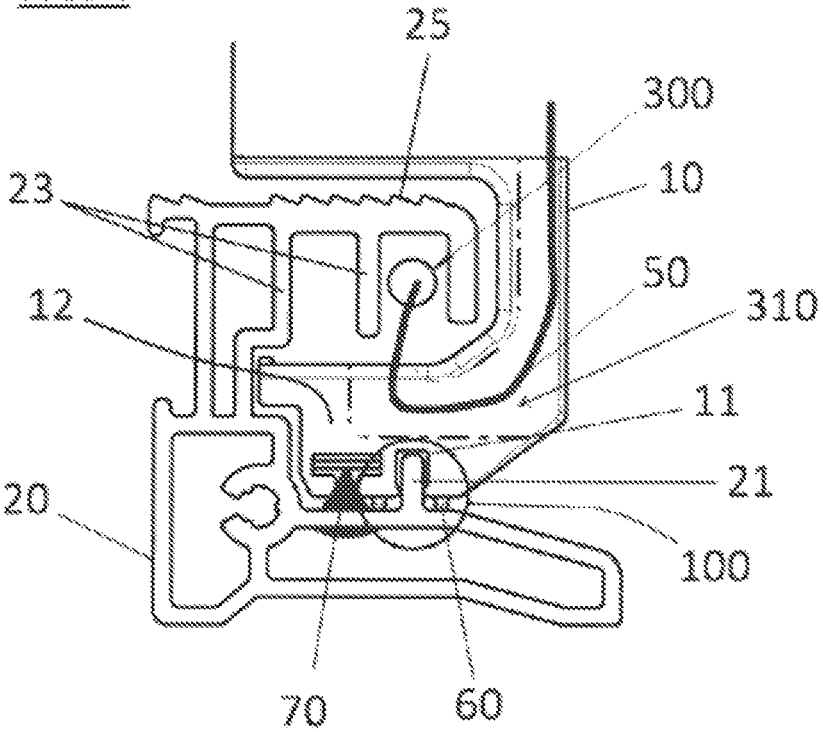
FIG. 4 shows a schematic view of the cord guide from the lower frame element into the lower end of the support strip according to a preferred embodiment of the system according to the invention.

As can be schematically seen in FIG. 4, the cover area 200 is continuously spaced apart from the lower end 10 of the support strip. The distance between the cover area 200 and the lower end may vary, as shown. Preferably, however, it should be at least 1 mm. A larger distance is preferred on the upper side of the cover area 200 since the upper side of the cover area 200, in particular if the cover area 200 also serves as a tread strip when the system is used in a door, is particularly easily soiled, which may lead to an impairment of the sliding.

Moreover, a cord area 300, through which a cord 50 is passed to tension the flexible curtain 2, may be provided within the cover area 200. The cord 50 is guided from the cord area 300 into a cord area 310 of the lower end 10 of the support strip 15.

Figure 5:
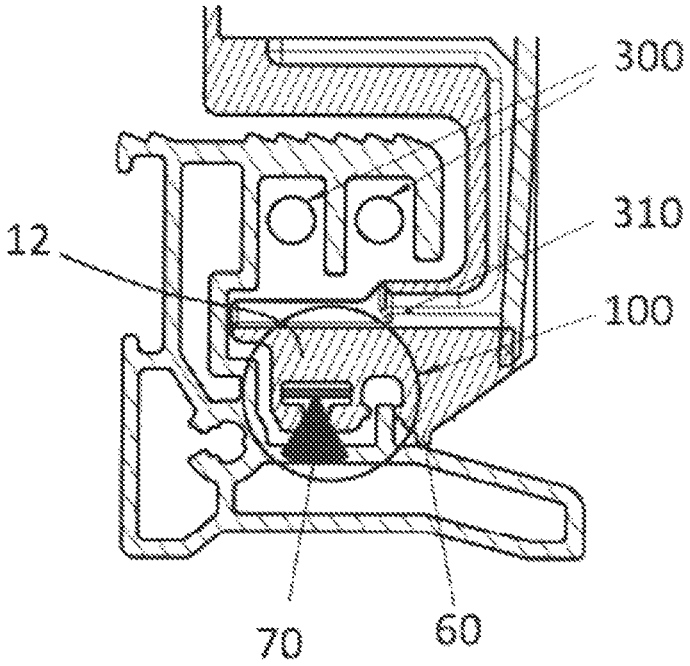
FIG. 5 shows a schematic view of the cord guide from the lower frame element comprising two cord areas into the lower end of the support strip according to a preferred embodiment of the present invention.

As schematically illustrated in FIG. 5, one or more cord areas 300 may be provided at different positions within the cover area 200 of the lower frame element 20. This allows the implementation of alternative cord guide concepts in which preferably no or very low torque is transmitted to the lower end of the support strip. Particularly preferably, the cord area 300 is provided centrally within the cover area 200 in a direction perpendicular to the plane of the opening.

Figure 6:
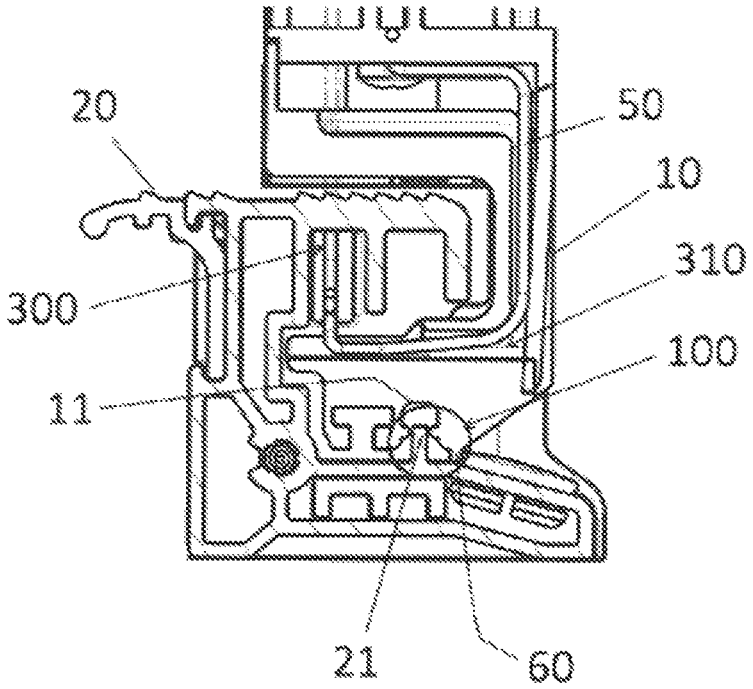
FIG. 6 shows a schematic view of the lower frame element comprising an inside cord area and of the lower end of the support strip according to a preferred embodiment of the present invention.

An alternative arrangement of the cord area 300 is illustrated in FIG. 6. The cord area shown here is located closer to an inner side of the lower frame element 20. Thus, the cord 50 is better protected against damage which may be caused, for example, by dirt entering the cover area.

The sliding element 12 may comprise a brush 70 (cf. FIGS. 4 and 5) to remove undesired particles, e.g., dirt, from the guide area 100 when the sliding element 12 moves relative to the lower frame element 20. The sliding surfaces of the system are thus cleaned with each movement of the sliding element 12 relative to the lower frame element 20. As can be seen in FIGS. 4 and 5, the guide area 100 of the lower frame element 20 is smaller than the guide area 100 of the lower frame element 20 in FIG. 2. Cleaning of the guide area 100 is thus simplified.

Figure 7:
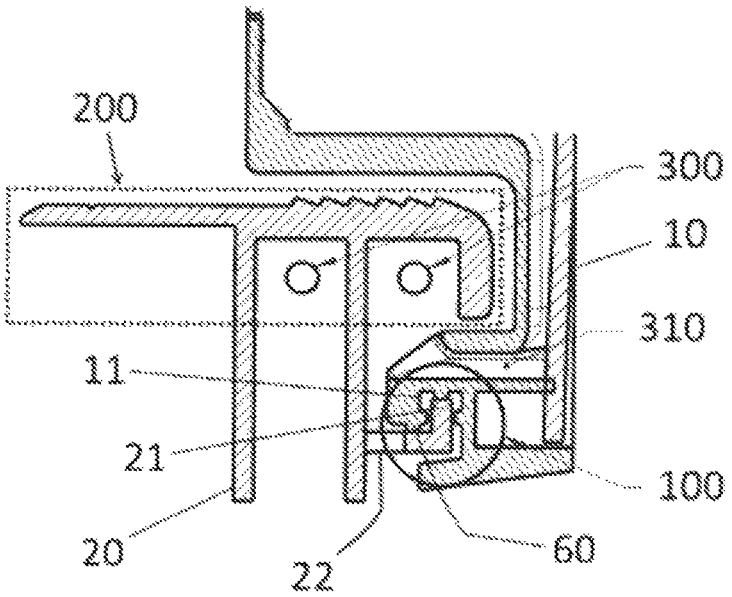
FIG. 7 shows a schematic view of the lower frame element comprising a wide tread strip according to a preferred embodiment of the invention.

FIG. 7 shows a further preferred embodiment of the present invention, in which the cross-sectional profile of the lower frame element 20 is modified compared to the embodiments described above. In this embodiment, the projection 21 is located on an additional arm 22 of the lower frame element 20. The sliders 60 are arranged on the inner side of the recess 11 so that the sliding element 12 touches the lower frame element 20 only in the area of the recess 11. Further contact points for guiding the support strip along the lower frame element 20 are not necessary. Thus, the size of the guide area 100 is considerably reduced and the guide area 100 can be more easily kept free of unwanted particles.

As illustrated in FIG. 7, the cover area 200 of the lower frame element 20 may also be wider than required to guide the lower end 10 of the support strip 15 along the lower frame element 20. Thus, a wider tread strip may be formed by the cover area 200. In addition to aesthetic reasons, this may also have an advantageous effect on the stability of the tread strip. Furthermore, this may reduce the risk of slipping when stepping on the tread strip.

Figure 8:
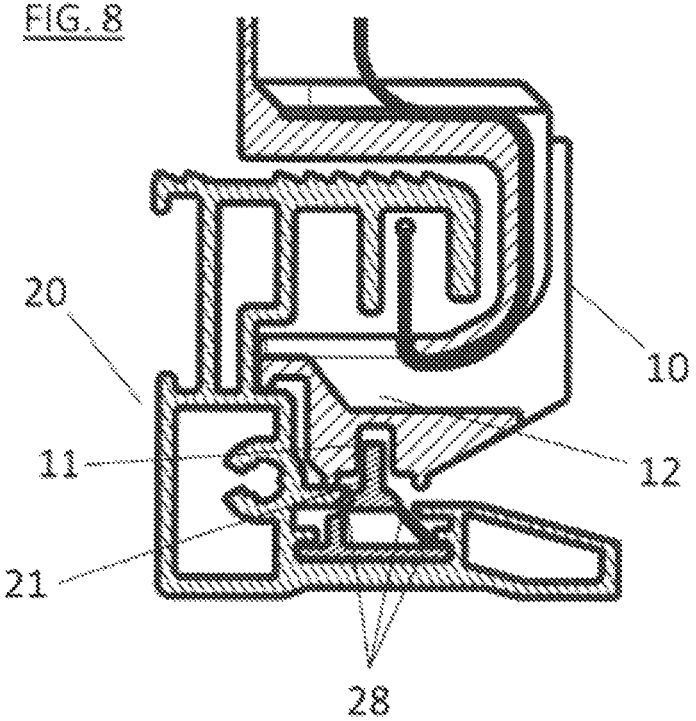
FIG. 8 shows a schematic view of the engagement of the sliding element with the lower frame element according to a preferred embodiment of the present invention.

In FIG. 8, the engagement of the sliding element 12 with the lower frame element 20 is schematically shown by means of a particularly preferred embodiment. In this embodiment, the connecting elements are exemplarily configured as a hinged bar or projection 21 on the lower frame element 20 and as a recess 11 on the sliding element 12. However, the arrangement may also be the other way round, i.e., a hinged bar or projection may be attached to the sliding element 12, while a recess may be provided on the lower frame element 20. Furthermore, combinations of several bars or projections and recesses are also conceivable.

Figure 9:
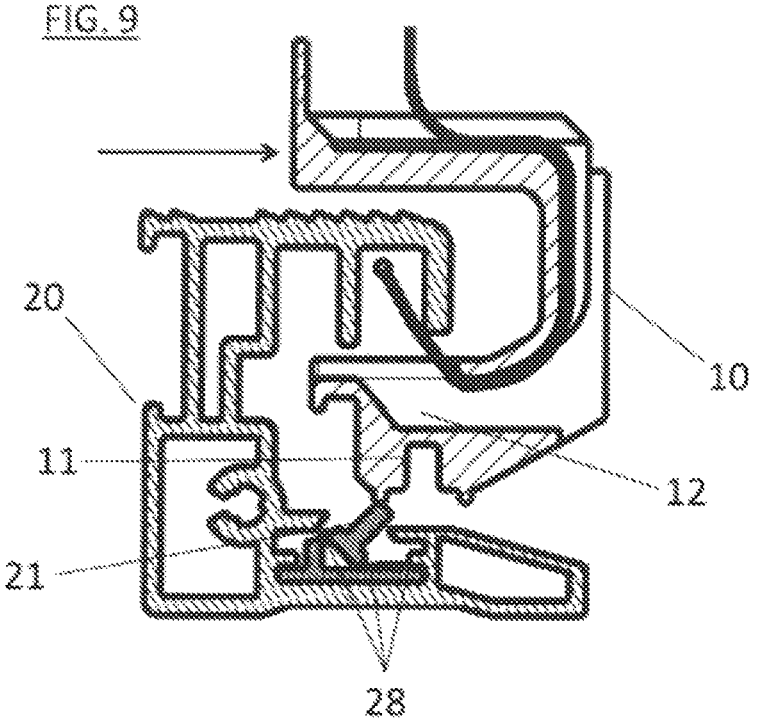
FIG. 9 shows a schematic view of the lower frame element and the lower end of the support strip after their engagement with each other was released under the influence of an external force, according to a preferred embodiment of the present invention.

As further schematically shown in FIG. 9, the hinged bar or projection 21 may fold over under the influence of a force onto the lower end 10 of the support strip 15 (in the direction of the arrow), whereby the engagement of the sliding element 12 with the lower frame element 20 is released and a lateral movement (in the direction of the arrow) of the sliding element 12 or the lower end 10 of the support strip 15 relative to the lower frame element 20 is made possible.

The hinged support of the bar or projection and/or the bar or projection may preferably be manufactured of plastic, such as, e.g., polyurethane. Alternatively, a bar or protrusion 21 manufactured of aluminum may be mounted in a hinged manner. In the illustrated embodiment, the entire bar 21 including the hinged support is configured as a one-piece injection molded part, wherein the three joints 28 are formed in that the material is configured to have a thinner wall thickness at the respective sites. Preferably, the wall thickness at the joints is less than 3 mm, more preferably less than 2 mm and especially preferably between 0.25 mm and 1.5 mm.

Figure 10:
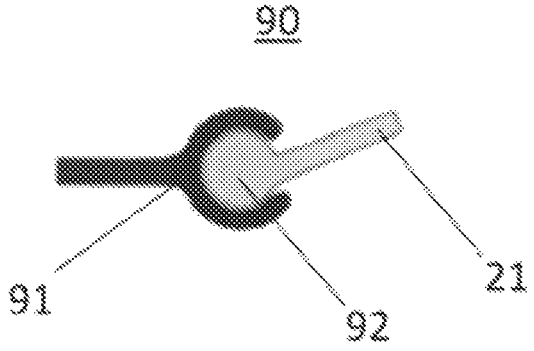
FIG. 10 shows a schematic view of a hinge connection.

However, instead of the illustrated joints 28, for example, film hinges or joints made of an elastic material may also be provided. The combination of a joint and a support alternatively could also comprise one or more spring elements. As a further alternative, a friction-based hinge connection 90 may also be provided. As shown in FIG. 10, such a hinge connection 90 may consist of a first hinge element 91 connected to the lower frame element 20 and a second hinge element 92 connected to the first hinge element 91. The engagement of the protrusion/bar 21 with the recess 11 is achieved by a retaining force resulting from the friction between the contact surfaces of the first and second hinge elements 91, 92. Under the influence of an external force, the magnitude of which is greater than the magnitude of the holding force, the second hinge element 92 can rotate relative to the first hinge element 91, whereby the bar 21 can fold over and release its engagement with the recess 11.

Of course, the hinged bar or the hinge element may also be used in the other illustrated preferred embodiments, wherein the hinge variant according to FIG. 10 is particularly well suitable for the embodiments of FIGS. 2 and 7.

The folding-over movement of the bar or projection 21 is preferably reversible, i.e., the sliding element 12 may be brought back into engagement with the lower frame element 20 via the recess 11 when the force ceases to be exerted. The restoring force required therefor may be generated by elasticities of the material used for the hinged support. Alternatively, the required restoring force may be provided by means of an additional elastic element on the hinged support of the bar or projection 21.

If the lower end 10 of the support strip 15 has a multi-part structure, the sliding element 12 may remain in engagement with the bar or projection 21 even under the influence of an external force. For this purpose, elements which enable a reversible uncoupling of the sliding element 12 from the remaining part of the lower end 10, for example, magnetic elements, may be provided between the sliding element 12 and the remaining part of the lower end 10 of the support strip 15.

The system according to the invention for guiding a flexible curtain for at least partially closing an opening offers the advantage that unwanted particles can be prevented from entering the guide area. This enables a low-friction movement between the sliding element and the lower frame element. Furthermore, damage to the sliding surfaces of the sliding element as well as of the lower frame element can be avoided thereby.

The system according to the invention is characterized in that, by separating the sliding element from the lower frame element, damage to the curtain can be avoided when an undesired external force acts on the support strip or the curtain.

Although the invention is illustrated and described in detail by means of the Figures and the respective description, this illustration and this detailed description are to be understood as illustrative and exemplary and not as limiting the invention. It is understood that persons skilled in the art may make changes and modifications without leaving the scope of the following claims. In particular, the invention also includes embodiments comprising any combination of features mentioned or shown above in connection with different aspects and/or embodiments.

The invention likewise comprises individual features in the Figures even if they are shown there in connection with other features and/or are not mentioned above.

In the context of the invention, the term "comprise" including derivatives thereof does not exclude other elements or steps. Likewise, the indefinite article "a" does not exclude a plurality. The functions of several features mentioned in the claims may be fulfilled by a unit. The terms "essentially", "approximately", "about" and the like in connection with a property and/or a value in particular also define exactly the property and/or exactly the value. All reference signs in the claims are not to be understood as limiting the scope of the claims.

The invention claimed is:

1. A system for guiding a flexible curtain for at least partially closing an opening, said system comprising:

an upper frame element, a lower frame element, and a first lateral frame element, which delimit the opening; and a support strip, wherein the first lateral frame element is configured to fix a first edge of a flexible curtain to a first side of the opening;

wherein the support strip is configured to hold a second edge of the flexible curtain;

wherein an upper and a lower end of the support strip are displaceably guided in the upper and lower frame elements;

wherein the lower frame element comprises a guide area and a cover area completely covering the guide area, which extend along a longitudinal direction of the lower frame element;

wherein a top side of the cover area comprises a tread strip configured to be stepped on by a person;

wherein the lower end of the support strip comprises a sliding element in order to be displaceably engaged with the guide area; and wherein there is a first distance between the lower end of the support strip and the cover area.

2. The system according to claim 1, wherein the sliding element comprises a brush on a side facing the guide area to remove unwanted particles from the guide area when the sliding element is moved relative to the lower frame element.

3. The system according to claim 1, further comprising a second lateral frame element that delimits the opening on a second side and is configured to be engaged with the support strip when the flexible curtain is in a fully stretched state.

4. The system according to claim 1, further comprising the flexible curtain, wherein the second edge of the flexible curtain is held by the support strip.

5. The system according to claim 1, wherein the system comprises a frame, and further comprising a door or a window in the frame.

6. The system according to claim 1, wherein a cross-section of the lower frame element and/or a cross-section of the lower end of the support strip is configured as a C-profile.

7. The system according to claim 6, wherein the cover area of the lower frame element extends into an opening formed by the C-profile of the lower frame element or the lower end of the support strip.

8. The system according to claim 1, wherein the sliding element and/or the guide area of the lower frame element comprise connecting elements configured to be brought into engagement with a corresponding connection element of the respective other one.

9. The system according to claim 8, wherein the connecting elements are configured as a bar/projection and/or as a recess.

10. The system according to claim 8, wherein at least one of the connecting elements is structured in a multi-part manner.

11. The system according to claim 8, wherein the connecting element of the sliding element is provided on a lower side of the sliding element.

12. The system according to claim 1, wherein the lower frame element comprises a cord area, through which a cord is passed to tension the flexible curtain.

13. The system according to claim 12, wherein the cord area is arranged above the guide area.

14. The system according to claim 1, wherein the sliding element is releasably engaged with the guide area.

15. The system according to claim 14, wherein the opening defines a plane and wherein the sliding element can be non-destructively detached from the guide area by a force acting perpendicularly to the plane.

16. The system according to claim 15, wherein the force required to detach the sliding element from the guide area is between 10 and 50 N.

17. A system for guiding a flexible curtain for at least partially closing an opening, said system comprising:

an upper frame element, a lower frame element, and a first lateral frame element, which delimit the opening defining a plane; and a support strip, wherein the first lateral frame element is configured to fix a first edge of a flexible curtain to a first side of the opening;

wherein the support strip is configured to hold a second edge of the flexible curtain;

wherein an upper and a lower end of the support strip are displaceably guided in the upper and lower frame elements;

wherein the lower frame element comprises a guide area;

wherein the lower end of the support strip comprises a sliding element;

wherein the guide area and the sliding element displaceably engage with each other via connecting elements; and wherein at least one of the connecting elements is configured in a deformable manner such that a movement of the support strip perpendicular to the plane defined by the opening is made possible.

18. The system according to claim 17, wherein at least one of the connecting elements is structured in a multi-part manner.

19. The system according to claim 17, wherein at least one of the connecting elements is non-destructively and reversibly deformable relative to the guide area and/or the sliding element in order to enable the movement of the support strip perpendicular to the plane defined by the opening.

20. The system according to claim 17, wherein the sliding element can be non-destructively detached from the guide area by a force acting perpendicularly to the plane defined by the opening.

21. The system according to claim 17, wherein the sliding element can be reattached to the guide area after it is detached.

22. The system according to claim 17, further comprising a second lateral frame element that delimits the opening on a second side and is configured to be engaged with the support strip when the flexible curtain is in a fully stretched state.

23. The system according to claim 17, further comprising the flexible curtain, wherein the second edge of the curtain is held by the support strip.

24. The system according to claim 17, wherein the system comprises a frame, and further comprising a door or a window in the frame.

* * * * *